United States Patent [19]

Stewart

[11] 4,384,247

[45] May 17, 1983

[54] UNDER-LOAD SWITCHING DEVICE PARTICULARLY ADAPTED FOR VOLTAGE REGULATION AND BALANCE

[75] Inventor: Richard E. Stewart, Bartlesville, Okla.

[73] Assignee: TRW Inc., Cleveland, Ohio

[21] Appl. No.: 261,892

[22] Filed: May 8, 1981

[51] Int. Cl.[3] ..... G05F 1/14

[52] U.S. Cl. ..... 323/256; 323/341

[58] Field of Search ..... 323/255, 256, 257, 258, 323/340, 341, 342, 901

[56] References Cited

U.S. PATENT DOCUMENTS

| | | | |
|---|---|---|---|
| 1,764,320 | 6/1930 | Kurda et al. | 323/340 |
| 2,449,367 | 9/1948 | Boyajian | 323/340 |
| 3,206,569 | 9/1965 | McCarty | 200/61.03 |
| 3,252,078 | 5/1966 | Conner | 323/43.5 |
| 3,359,485 | 12/1967 | Buhler | 323/43.5 |
| 3,381,213 | 4/1968 | Rice et al. | 323/257 |
| 3,436,646 | 4/1969 | Prescott | 323/43.5 |
| 3,544,884 | 12/1970 | Prescott | 323/43.5 |
| 3,555,404 | 1/1971 | Bleibtreu | 323/43.5 |
| 3,581,188 | 5/1971 | Watanabe et al. | 323/43.5 |
| 3,594,631 | 7/1971 | Trachsel | 323/43.5 |
| 3,622,867 | 11/1971 | Topper et al. | 323/43.5 |
| 3,628,128 | 12/1971 | Buhler | 323/43.5 |
| 3,651,375 | 3/1972 | Ebersohl | 317/11 |
| 3,663,951 | 5/1972 | Prescott | 323/43.5 |
| 3,720,867 | 3/1973 | Rathbun | 323/43.5 |
| 3,735,243 | 5/1973 | Downs et al. | 323/43.5 |
| 3,783,206 | 1/1974 | Lingenfelter | 200/11 |
| 4,081,741 | 3/1978 | Palmer | 323/43.5 |

OTHER PUBLICATIONS

Westinghouse Transmission and Distribution Reference Book, Fourth Edition, Chapter 5, pp. 121–122.

Stewart, R. E., "The Effects of Power Supply Integrity on Electrical Submergible Pumping Systems", SPE Paper No. 9038.

*Primary Examiner*—William M. Shoop

*Assistant Examiner*—Peter S. Wong

*Attorney, Agent, or Firm*—Shapiro and Shapiro

[57] ABSTRACT

An under-load switching device particularly adapted for use with a transformer having voltage taps for voltage regulation and for balancing the phase voltages in a multi-phase AC power system includes a pair of rotary tap selectors connected in parallel to the voltage taps, and a pair of switches for alternately connecting the tap selectors to an AC line, such that load current flows through only one tap selector and an associated switch at a time. A control unit monitors the voltage on the AC line, determines the tap required to be selected to compensate for voltage variations, causes the tap selector which is not carrying load current to select the required tap, and operates the switches at a zero-current point to transfer the AC line to the selected tap.

14 Claims, 1 Drawing Figure

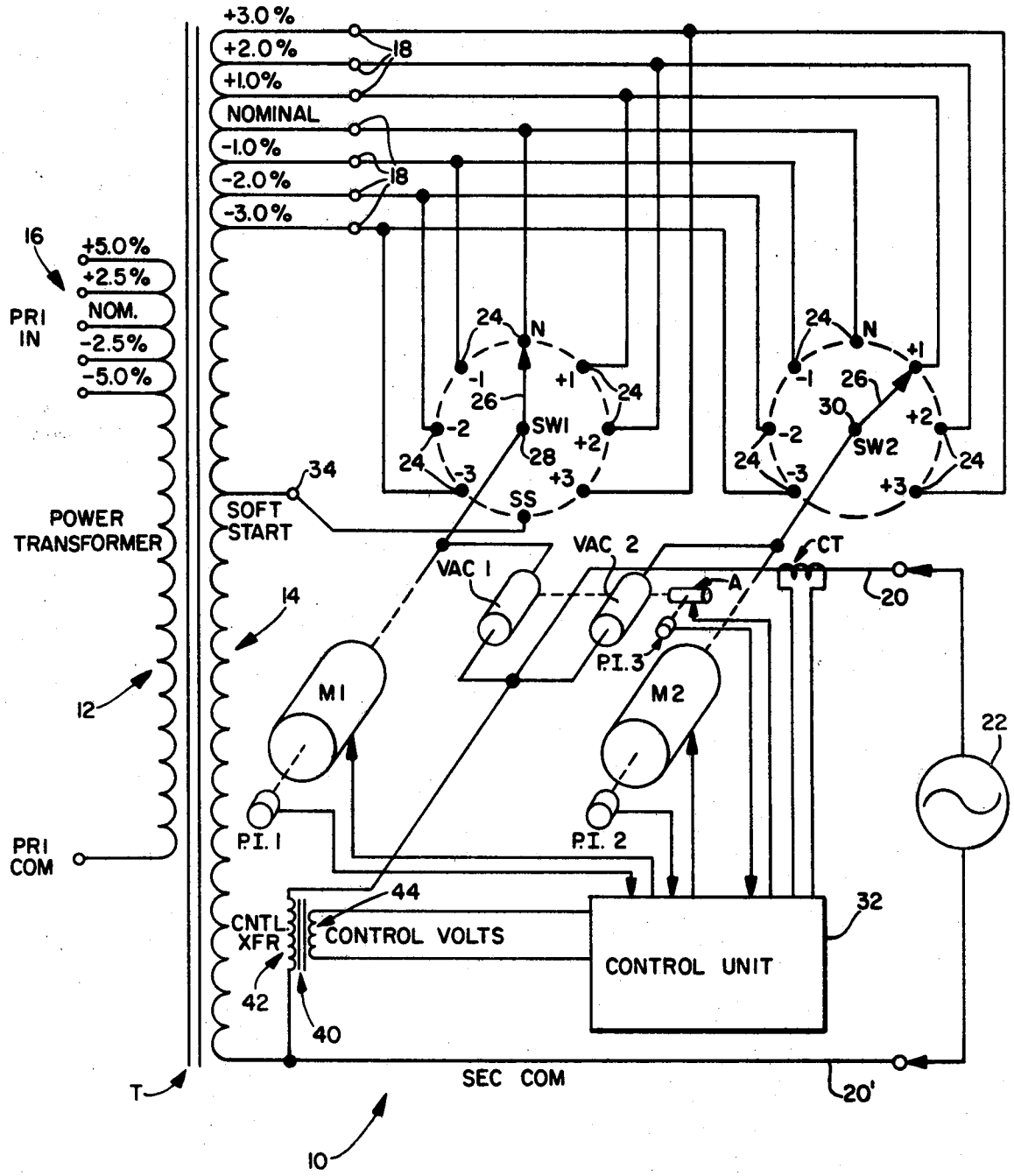
+3.0%
+2.0%
+1.0%
NOMINAL
-1.0%
-2.0%
-3.0%
18
16
+5.0%
+2.5%
NOM.
-2.5%
-5.0%
PRI IN
POWER TRANSFORMER
12
PRI COM
T
14
SOFT START
34
24
N
-1
+1
26
-2
SW1
+2
28
-3
+3
SS
30
SW2
VAC 1
VAC 2
CT
A
20
P.I. 3
M1
M2
P.I. 1
P.I. 2
22
44
CNTL. XFR
CONTROL VOLTS
42
40
CONTROL UNIT
32
SEC COM
20'
10

UNDER-LOAD SWITCHING DEVICE PARTICULARLY ADAPTED FOR VOLTAGE REGULATION AND BALANCE

BACKGROUND OF THE INVENTION

This invention relates generally to under-load switching devices, and more particularly to under-load switching devices useful for regulation and balance of AC voltages.

There are many electrical systems that are sensitive to voltage changes. AC powered systems may be very sensitive to variations in the AC voltage level supplied to the system, and multi-phase systems may be very sensitive to unbalances of or differences between the phase voltages.

Voltage variations and phase unbalance are problems in oil well pumping systems employing electrically driven submergible pumps. The motors used for driving submergible pumps are generally three-phase AC motors having a somewhat unusual design. They have a very small diameter and a relatively long length. Their large length-to-diameter ratio combined with a hostile downhole environment imposes very severe duty on such motors. If the severe duty is coupled with poor regulation of the AC voltage level and poor voltage balance between phases, the life of the motor may be severely reduced. It is desirable, therefore, to regulate the AC power in order to maintain relatively constant voltage levels and balance between phase voltages as the load and other system conditions change. Furthermore, it is desirable to perform such regulation and balance under load conditions.

There are devices that are capable of regulating and balancing AC voltages and that do not require voltage switching. Phase controlled rectifiers may be employed for converting the AC voltage to a DC voltage, which is regulated and then reconstituted as an AC waveform using an inverter circuit. Controlled variable impedances, such as saturable core reactors, may be inserted in series with the AC lines and level regulation and balance between phases achieved by varying the voltage drop across each impedance to compensate for variations in voltage levels or phase voltage unbalances. Such devices are complex and costly, and have other disadvantages.

Tapped power transformers may be employed for voltage regulation and balance purposes; however, tap changers, i.e., switching devices, are necessary for switching between voltage taps. Known tap changers generally comprise a plurality of switches connected to the voltage taps and to the AC line feeding a load through a plurality of current-interrupting switches. In order to operate under load, the tap changers are generally of the step-switching type, wherein a tap changing operation involves the sequential selection of adjacent taps, i.e., adjacent voltage levels, and the momentary connection of the adjacent taps together. Various protective devices such as auto-transformers or current-limiting impedances are necessary to reduce the circulating currents flowing between the connected taps. Such tap changers generally do not permit the independent selection of non-adjacent taps in a single tap-changing operation, but require a series of steps in which adjacent taps are sequentially selected until the desired tap is reached.

Tap changers of the step-switching type just described require multiple switches and require special transformers having an extra winding for the protective auto-transformer (otherwise an external auto-transformer or current-limiting impedance is required). However, such transformers are not generally available in the sizes required for submergible pump installations. In addition to being relatively complex and expensive, step-switching tap changers, requiring multiple switching operations to switch between non-adjacent taps, are not capable of quickly responding to variations in voltage level and have other disadvantages.

SUMMARY OF THE INVENTION

This invention provides under-load switching devices which may be employed as tap changers with tapped power transformers, e.g., for voltage regulation and balance purposes, and which overcome the problems of known switching devices. Advantageously, switching devices in accordance with the invention have a relatively simple and inexpensive construction, and may be implemented with a relatively small number of components. When used as tap changers, they do not require special transformers, protective auto-transformers, or other current-limiting impedances, but may be used with standard commercially available tapped transformers to enable tap changing under load between non-adjacent taps in a single operation, thereby enabling good voltage regulation and balance to be achieved. Other advantages of the invention will become apparent hereinafter.

Briefly stated, an under load switching device in accordance with the invention for switching between transformer taps and the like may include first and second selector means adapted to be connected in parallel to a plurality of the transformer taps, each selector means being capable of independently selecting any tap of the plurality, means for operating the first and second selector means, first and second switch means connected to the first and second selector means, respectively, and operable for alternately connecting a tap selected by the first selector means and a tap selected by the second selector means to a conductor, means for operating the first and second switch means such that only one selected tap is connected to the conductor at a time, and means for determining which selector means selects the tap that is connected to the conductor to enable operation of the other selector means, thereby permitting tap selection under no-load conditions.

BRIEF DESCRIPTION OF THE DRAWING

The single FIGURE is a schematic view of a switching device in accordance with the invention employed with a transformer.

DETAILED DESCRIPTION OF THE PREFERRED EMBODIMENT

Under-load switching devices in accordance with the invention are particularly adapted for use with tapped transformers to provide voltage regulation and balance in AC power systems, and will be described in that environment. As will become apparent, however, this is illustrative of only one utility of the invention.

Referring to the FIGURE, a switching device 10 in accordance with the invention is shown employed with a transformer T having a primary winding 12 and a secondary winding 14. Transformer T may be a single-phase power transformer or may be one phase of a three-phase transformer, as explained hereinafter. As shown, the primary winding 12 may have a plurality of voltage taps 16, e.g., at 2.5% voltage intervals, as shown, to enable coarse adjustment of the secondary voltage at installation. Secondary winding 14 may also have a plurality of voltage taps 18 which, as shown, may be at 1.0% voltage intervals above and below the nominal rated secondary voltage of the transformer. By selecting different taps 18, the secondary voltage may be increased or decreased from nominal in 1.0% intervals.

Although the secondary winding is illustrated in the FIGURE as having only three voltage taps above nominal (labeled +1.0%, +2.0%, and +3.0%), and three voltage taps below nominal (labeled −1.0%, −2.0%, and −3.0%), it is understood that the invention may be employed with transformers having a greater or lesser number of taps, as well as taps spaced at different voltage intervals. Typically, it is desirable to regulate and balance the AC power feeding an electrically driven submergible pump to within 1% for system level variations of up to ±5%. A system designed on that basis would enable 2% regulation to be achieved for system level variations up to ±10%. By appropriately selecting transformers having different tap arrangements, different regulation and balance ranges may be easily accommodated.

The switching device 10 of the invention enables the voltage on a secondary conductor or AC line 20, which may feed an electrical motor 22, for example, to be maintained relatively constant for variations in load or other system conditions by appropriately switching the AC line to different voltage taps to compensate for the variations. As will be explained, the invention accomplishes this function, under load, in a novel manner and with a simplified arrangement of components.

As shown in the FIGURE, the invention employs first and second tap selectors SW1 and SW2, respectively, which are preferably rotary non-load break switches, each having a plurality of stationary contacts 24 and a movable contact or wiper 26. The stationary contacts of the rotary switches are connected in parallel to the secondary voltage taps 18 of the transformer. As shown, each stationary contact is connected to a different voltage tap, the tap to which each stationary contact is connected being indicated by a number of corresponding to the percentage difference of the voltage level of the tap from the nominal voltage. By moving wipers 26 to different stationary contacts, different taps 18 may be selected, and the voltages corresponding to the particular selected taps are output on terminals 28 and 30 of rotary switches SW1 and SW2, respectively. The positions of the wipers of rotary switches SW1 and SW2 may be varied by respective actuator motors M1 and M2, which may be stepping motors, for example. In turn, motors M1 and M2 may be operated by a control unit 32, in a manner which will be described hereinafter, to drive the wipers to the positions required to select the desired taps.

As is also shown in the FIGURE, secondary winding 14 of the transformer may have an additional voltage tap 34 connected to a stationary contact SS of rotary switch SW1, to enable a reduced voltage to be applied to AC line 20 for "soft starting" of motor 22.

The output terminals 28 and 30 of rotary switches SW1 and SW2, respectively, may be connected to the AC line 20 through respective switches VAC1 and VAC2, as shown in the FIGURE. Switches VAC1 and VAC2 are preferably bistable break-before-make vacuum contactors, each having an open position and a closed position, and are mechanically coupled together and to a movable member (not illustrated) of an actuator solenoid A (as indicated by the dotted line in the FIGURE between VAC1, VAC2 and A) for simultaneous operation. The vacuum contactors are arranged such that when one vacuum contactor is in closed position, the other vacuum contactor is in open position, and vice versa. Accordingly, by appropriately controlling actuator solenoid A, output terminals 28 and 30 of rotary switches SW1 and SW2 are alternately connected to the AC line 20. Actuator solenoid A preferably has two control windings which are alternately energized to switch the solenoid back and forth between first and second states corresponding to the two positions of the vacuum contactors. By employing an actuator solenoid having two control windings, hysteresis effects are minimized, thus minimizing any difference in the switching times required to switch the solenoid in opposite directions. Actuator solenoid A may be operated by the control unit 32, in a manner which will be described shortly.

As is also shown in the FIGURE, the switching device of the invention may include a control transformer 40 having its primary 42 connected across the secondary output of transformer T between AC line 20 and secondary common line 20', and having its secondary 44 connected to the control unit 32. Control transformer 40 monitors the voltage on AC line 20 and supplies a control voltage proportional to this voltage to the control unit where the control voltage may be compared with a predetermined reference voltage. If the voltage on AC line 20 varies beyond a preselected range, e.g., 1.0%, the control voltage from transformer 40 will vary proportionately from the predetermined reference voltage. Preferably, the control unit responds to deviations of the control voltage from the predetermined reference voltage and operates automatically to bring the voltage on AC line 20 back to its required level, as will be described shortly.

The switching device of the invention may further include a current transformer CT connected to the control unit, as shown, for monitoring the load current flowing in AC line 20. The control unit may incorporate a well-known zero-crossing detector which cooperates with current transformer CT to detect zero-crossings of the current flowing in the AC line, for a purpose which will be described shortly. The device may further include position indicators PI1 and PI2 mechanically coupled to motors M1 and M2, respectively, and electrically connected to the control unit for monitoring the positions of rotary switches SW1 and SW2. Similarly, a position indicator PI3 may be coupled to actuator solenoid A, as shown, for monitoring the position of the actuator solenoid.

Position indicators PI1–PI3 may be any of a variety of well-known devices, such as switches, optically encoded devices or variable resistors, which produce different outputs for the different positions of rotary switches SW1 and SW2 and actuator solenoid A. Preferably, position indicators PI1 and PI2 comprise rotary switches having the same numbers of positions as rotary switches SW1 and SW2, respectively, and arranged so that they step from one position to another in unison with the movements of wipers 26 of SW1 and SW2 between contacts 24, to indicate the positions of the wipers. Position indicator PI3 may be a two-position switch which is mechanically coupled to the movable member to actuator solenoid A so that it switches between positions as the actuator solenoid switches between states.

The invention enables the voltage on AC line 20 to be monitored via control transformer 40, and enables voltage regulation by appropriately changing voltage taps to either increase or decrease the voltage as required to compensate for variations. Regulation of the voltage on AC line 20 is performed under load. However, tap selection is performed under no-load conditions, as will now be explained.

As previously described, only one of the vacuum contactors VAC1 or VAC2 is in closed position at any given time. Accordingly, load current flows through only one of the tap selector rotary switches SW1 or SW2 at any given time. Tap changing is accomplished by operating the rotary switch which is not carrying load current to select a desired tap 18, thereby eliminating arcing in the rotary switches which would otherwise accompany tap changing. Since the rotary switches are not required to break the load current, they may be relatively inexpensive devices. After the desired tap is selected, is is then connected to AC line 20 by simultaneously operating the vacuum contactors by means of actuator solenoid A to reverse their positions, disconnecting the line from the original tap and reconnecting it to the new tap. To minimize arcing in the vacuum contactors and transients on the AC line, the current flowing in the AC line may be monitored by the current transformer CT and the vacuum contactors may be switched at a zero-current point.

Control unit 32 may be a manually operated unit having front panel control switches and indicators (not illustrated) to enable manual operation of the tap selector motors M1 and M2 and the actuator solenoid A. For manual control purposes, the control voltage from control transformer 40 may be applied to a meter which is calibrated to read the level of the voltage on the AC line, and the position indicators may be connected to indicator bulbs which indicate the positions of the tap selector motors and the actuator solenoid. The front panel control switches may operate relays within the control unit for appropriately energizing the tap selector motors and the actuator solenoid to perform a tap changing operation. To enable switching of the AC line at a zero-current point, an output of the zero-crossing detector and a control signal from a control switch which operates actuator solenoid A may be supplied to a digital logic circuit, for example, which outputs a signal pulse for operating the actuator solenoid only when the control signal and a zero-crossing signal are both present at its input.

Although a manual control unit may be used, when the switching device of the invention is employed for voltage regulation and balance purposes, it is preferable for the control unit to automatically respond to voltage variations and to appropriately control the tap selectors and the vacuum contactors to compensate for the variations. A control unit capable of automatic operation may be implemented using well-known devices and techniques, and may employ analog, digital, or electromechanical circuits, or combinations thereof, arranged to perform the desired functions. For example, for detecting voltage variations on the AC line, the control voltage from control transformer 40 may be rectified, filtered, and compared with a predetermined reference DC voltage produced within the control unit. Comparator circuits may be employed for detecting variations from the reference voltage and for supplying control signals representative of the magnitude and direction of the voltage variations. The position indicators PI1–PI3 may be connected to position monitoring circuits which provide output signals representative of the positions of the tap selector switches and the actuator solenoid. Other circuits, responsive to the output signals from comparator circuits and from the position monitoring circuits, may be employed for determining the appropriate tap which must be selected to compensate for the variations and for controlling the tap selector switch which is not carrying load current, as determined by the position of the actuator solenoid, to select the desired tap. Once the desired tap has been selected, as indicated by an appropriate position monitoring circuit, an actuator solenoid switching signal may be generated and supplied to a digital logic circuit with an output from the zero-crossing detector, in the manner previously described, for switching the vacuum contactors at a zero-current point.

Preferably, the control unit includes a microprocessor for performing the above-described functions. The control voltage may be digitized, supplied to the microprocessor, and the microprocessor employed for determining the tap required to be selected to compensate for variations. The microprocessor may also monitor the positions of the tap selectors and the actuator solenoid, and control the tap selector which is not carrying load current to select the desired tap. The microprocessor may also receive the output signals from the zero-crossing detector and, after the desired tap has been selected, cause the actuator solenoid to be energized to switch the vacuum contactors at a zero-current point.

A microprocessor is especially convenient for timing the switching of the vacuum contactors so that switching occurs precisely at a zero-current point. Although the vacuum contactors are able to switch very rapidly between their open and closed positions, there will be some electromechanical time constant associated with their operation (primarily due to the actuator solenoid) and some finite time delay between the initiation of a switching operation and the actual switching of the vacuum contactors. Therefore, it is desirable to compensate for this time delay by initiating a switching operation just prior to the occurrence of a zero-current point. Since the microprocessor receives the output signals from the zero-crossing detector, it may be employed for timing actual zero crossings to determine an average time between zero crossings (thereby compensating for variations due to changes in line frequency, for example), and for timing the initiation of a switching operation to compensate for the time delay. Furthermore, if there are different time delays associated with switching the vacuum contactors in different directions, these differences can be accommodated easily by the microprocessor.

To illustrate an automatic tap changing operation for voltage regulation purposes, assume that the wipers of both rotary switches are in the N (nominal) position and that vacuum contactor VAC1 is closed. Load current will flow through rotary switch SW1 and VAC1 to the AC line 20. If the voltage should decrease by 1.0%, for example, the control voltage supplied to the control unit by transformer 40 will decrease by 1.0% from the predetermined reference voltage. Based upon the magnitude and direction of the change in the control voltage from the predetermined reference voltage, the control unit determines the percentage change in tap voltage required to bring the voltage level back to the desired value. In this example, a 1.0% increase is required. Position indicator PI3 indicates to the control unit that VAC1 is closed and VAC2 is open. Accordingly, the control unit will cause the new tap to be selected by rotary switch SW2, which is not carrying load current.

Since both rotary switches were assumed to be in the N position, which will be indicated to the control unit by position indicators PI1 and PI2, the control unit will energize motor M2 to move wiper 26 of rotary switch SW2 to the +1 position, selecting the +1.0% voltage tap. After tap selection by rotary switch SW2 has occurred, the control unit will energize actuator solenoid A to open VAC1 and close VAC2 upon the load current in AC line 20 reaching a zero-current point. Since the vacuum contactors are break-before-make switches, the AC line will be momentarily disconnected from the voltage taps during switching. However, since switching occurs very rapidly and is performed at a zero-current point, arcing in the vacuum contactors and line transients are minimized, as previously described. After switching, VAC2 will remain closed and rotary switch SW2 will remain connected to the AC line until another tap changing operation is required.

If the voltage on the AC line should subsequently vary again, another tap changing operation would be performed, this time using rotary switch SW1 to select the new tap. When the new tap is selected, the positions of the vacuum contactors will be reversed to connect rotary switch SW1 to the AC line and to disconnect rotary switch SW2.

As will be appreciated from the foregoing, a significant advantage of the invention is that taps are never connected together, nor is more than one tap connected to the AC line at a time. Accordingly, there are no circulating currents and, hence, there is no requirement for protective auto-transformers or current-limiting impedances as in many known devices. Moreover, the rotary switches SW1 and SW2 operate independently of one another, and each is capable of selecting any of the taps without regard to the tap selected by the other rotary switch. Thus, tap changing may be performed between non-adjacent taps in a single operation, rather than as a series of steps as required by many known devices. This enables better regulation of the voltage to be achieved.

When used to regulate and balance the voltages between phases in a three-phase power system, each phase would have a separate switching device 10 as illustrated in the FIGURE, except that a common control unit may be employed for all three phases, if desired, which is capable of controlling separately the switching device associated with each phase. In addition, it will be appreciated that the switching device of the invention may also be employed on the primary of a transformer for selecting primary taps, instead of on the transformer secondary as illustrated and described.

While only a single preferred embodiment of the invention has been shown and described, it will be apparent to those skilled in the art that changes can be made in this embodiment without departing from the principles and spirit of the invention, the scope of which is defined in the appended claims. For example, rather than using motor-driven rotary switches for the tap selectors, other switching arrangements may be employed, such as pluralities of interconnected solid state or electromechanical switches controlled by electronic circuits.

I claim:

1. A device for switching, under load, between transformer taps and the like, there being a plurality of such taps, comprising first and second selector means adapted to be connected in parallel to said plurality of taps, each selector means being capable of independently selecting any tap of said plurality, means for operating the first and second selector means, first and second switch means connected to said first and second selector means, respectively, and operable for alternately connecting a tap selected by the first selector means and a tap selected by the second selector means to a conductor, means for operating the first and second switch means such that only one selected tap is connected to the conductor at a time, and means for determining which selector means selects the tap that is connected to the conductor to enable operation of the other selector means, thereby permitting tap selection under no-load conditions.

2. The device of claim 1, wherein the first and second selector means each has a plurality of first contacts, each first contact being connected to one of the plurality of taps, and each has a second contact connectable, in succession, to each of the first contacts.

3. The device of claim 2, wherein the means for operating the first and second selector means includes means for varying the connections between the first and second contacts of each of the first and second selector means to connect the second contacts to successive first contacts.

4. The device of claim 3, wherein the first and second selector means comprise first and second rotary switches, the first contacts being stationary contacts of said switches and the second contacts being a movable contact of each switch, and wherein the varying means comprises first and second motor means connected to the movable contacts of the first and second rotary switches, respectively, for varying the positions of the movable contacts.

5. The device of claim 4, wherein the means for operating the first and second selector means further comprises means for selectively controlling the first and second motor means.

6. The device of claim 4, wherein the means for operating the first and second selector means comprises means for monitoring the positions of the movable contacts of the first and second rotary switches.

7. The device of claim 2, wherein the means for operating the first and second selector means includes means for monitoring the voltage level on said conductor, and control unit means for detecting variations between said voltage level and a reference voltage level and for determining the tap required to be selected to compensate for the variations.

8. The device of claim 7, wherein the control unit means includes means responsive to the first-mentioned determining means for operating said other selector means which selects a tap which is not connected to the conductor to connect the second contact of said other selector means to a first contact of the same that is connected to said tap required to be selected to compensate for the variations.

9. The device of claim 1, wherein the first and second switch means comprise first and second break-before-make switches, each having an open position and a closed position, and the switches are related to each other such that when one switch is in open position the other switch is in closed position.

10. The device of claim 9, wherein said first and second switches comprise first and second vacuum contactors connected in parallel to the conductor and to said first and second selector means, respectively.

11. The device of claim 1, wherein the means for operating the first and second switch means includes means for monitoring the current carried by the conductor, and control unit means for operating the first and second switch means at a zero-current point.

12. The device of claim 11, wherein said current monitoring means comprises a current transformer.

13. The device of claim 1, wherein said plurality of voltage taps are on the secondary of the transformer, and the conductor is connected to a load.

14. The device of claim 13, wherein said load is an AC motor, and the transformer secondary includes a soft start voltage tap selectable by one of said first and second selector means to enable a reduced voltage to be applied to the AC motor for starting.

* * * * *